United States Patent [19]

Driscoll et al.

[11] Patent Number: 4,628,947

[45] Date of Patent: Dec. 16, 1986

[54] PROCESS FOR MODIFYING THE FLAVOR CHARACTERISTICS OF BRIGHT TOBACCO

[75] Inventors: Dennis M. Driscoll; Everett W. Southwick, both of Richmond, Va.

[73] Assignee: Philip Morris Incorporated, New York, N.Y.

[21] Appl. No.: 752,022

[22] Filed: Jul. 5, 1985

[51] Int. Cl.[4] ..... A24B 15/28

[52] U.S. Cl. ..... 131/297; 131/308

[58] Field of Search ..... 131/297, 298, 309

[56] References Cited

U.S. PATENT DOCUMENTS

| | | |
|---|---|---|
| 246,975 | 9/1881 | Phillips . |
| 1,577,768 | 3/1926 | Smith . |
| 1,640,298 | 8/1927 | Sartig . |
| 1,671,259 | 5/1928 | Schloesing . |
| 1,719,291 | 7/1929 | Federmann . |
| 1,984,445 | 1/1934 | Wagner . |
| 2,122,421 | 7/1938 | Hawkinson . |
| 2,136,485 | 11/1938 | Berka . |
| 2,148,147 | 2/1939 | Baier . |
| 2,162,738 | 6/1939 | McCoy . |
| 2,170,107 | 8/1939 | Baier . |
| 2,223,053 | 11/1940 | Baier . |
| 2,227,863 | 1/1941 | Rhodes . |
| 2,264,745 | 12/1941 | Elliott . |
| 2,274,649 | 3/1942 | Baier . |
| 2,525,785 | 10/1950 | Feinstein et al. . |
| 2,822,306 | 2/1958 | Thienmann . |
| 3,147,199 | 9/1964 | Neel . |
| 3,147,200 | 9/1964 | Neel . |
| 3,151,118 | 9/1964 | Moser . |
| 3,483,874 | 12/1969 | Hind . |
| 3,742,962 | 7/1973 | Brochot . |
| 3,771,533 | 11/1973 | Armstrong . |
| 3,821,960 | 6/1974 | Egri . |
| 4,079,742 | 3/1978 | Rainer . |
| 4,123,592 | 10/1978 | Rainer . |
| 4,184,495 | 1/1980 | Rainer . |
| 4,266,562 | 5/1981 | Merritt . |
| 4,286,606 | 9/1981 | Swain . |
| 4,306,577 | 12/1981 | Wu . |
| 4,379,464 | 4/1983 | Wu . |

FOREIGN PATENT DOCUMENTS

| | | |
|---|---|---|
| 2272612 | 12/1975 | France . |
| 55127980 | 3/1980 | Japan . |
| 1288168 | 6/1972 | United Kingdom . |

*Primary Examiner*—V. Millin

[57] ABSTRACT

A method for modifying the smoking flavor characteristics of bright tobacco, involves treating the tobacco with liquid ammonia, separating the resulting ammonia solution from the tobacco, concentrating the solution by evaporating the ammonia, dissolving the concentrate in a solvent and reapplying the dissolved residue to the once-treated tobacco.

9 Claims, No Drawings

PROCESS FOR MODIFYING THE FLAVOR CHARACTERISTICS OF BRIGHT TOBACCO

BACKGROUND OF THE INVENTION

The present invention relates generally to modified flavor characteristics of tabacco, and more specifically to a method for modifying the smoking flavor characteristics of cured bright tobacco with ammonia and without the addition of ingredients extraneous to tobacco.

Treatment of tobacco with various forms of ammonia has been a step employed in many tobacco-processing methods. Gaseous ammonia has been classically employed to prevent the growth mold or sweating of tobacco (see, e.g., U.S. Pat. No. 246,975) and more recently as a means to displace and effect release of nicotine. Representative of such denicotinization processes are those disclosed in U.S. Pat. Nos. 1,640,298 (Sartig), 1,719,291 (Federmann), 2,136,485 (Berka et al.), 2,162,638 (McCoy), 2,227,863 (Rhodes), and 3,742,962 (Brochot). In some of these processes the ammonia gas is combined with another agent, e.g., steam, acetic acid, carbamic acid, hydrogen peroxide or an alkali hydroxide. In every instance, there is removal of components, notably nicotine, from the tobacco and generally speaking no effort is made to maintain the presence of ammonia without dilution or removal.

Aqueous ammonia solutions have been employed in procedures for extracting nicotine from tobacco and in procedures for expanding tobacco. Rhodes U.S. Pat. No. 2,227,863 extracts tobacco with fluorocarbons after pretreatment with a dilute aqueous ammonia solution; Fienstein et al. U.S. Pat. No. 2,525,785 employs ethylene dichoride and aqueous ammonia for the same purpose. Ammonia was disclosed as an expansion agent for tobacco by Armstrong et al. U.S. Pat. No. 3,771,533. This process involves impregnation of tobacco with liquid or gaseous ammonia and exposure of the resulting tobacco to very rapid heating in unconfined (open vessel) conditions to bring about expansion with release of the ammonia. Similarly, Merritt U.S. Pat. No. 4,266,562 employed liquid ammonia and carbon dioxide for expansion.

Improvements in non-tobacco smoking materials have also been achieved by the extractive removal of selected components using liquid ammonia. For example, in U.S. Pat. No. 4,079,742, a non-tobacco smoking product is made by pyrolyzing a cellulosic material and then extracting pyrolytically generated tars with basic liquids, such as liquid ammonia, to effect a 15% to 40% reduction in the weight of the pyrolyzed cellulose.

Finally, ammonia has also been employed in the area of flavoring tobacco. Rainer U.S. Pat. Nos. 4,123,592 and 4,184,495 incorporate volatile flavorants into smoking material through impregnation in liquid ammonia solvent or ammonia mixed with a co-solvent. The liquid ammonia, acting as a swelling agent for the cellulosic polymer structure, allows migration and incorporation of the flavor molecules into the polymers.

The foregoing treatments of the prior art employing ammonia are directed to a variety of results, e.g. expansion, extraction and flavoring, and are generally of a complex, multi-step nature causing significant chemical and/or physical transformation, sacrificing considerable weight fractions of the tobacco undergoing treatment, and frequently resulting in the accumulation of by-products representing a disposal problem.

There remains therefore a need in the art for a simple treatment process for employing ammonia to improve the smoking quality of tobacco material, involving minimal losses of product weight and without the addition of extrinsic matter to the tobacco, which upon pyrolysis may be undesirable.

SUMMARY OF THE INVENTION

The present invention provides a simple method for desirably modifying the flavor characteristics of bright tobacco which employs only ammonia and products inherent in the tobacco itself.

The present invention alters the smoke flavor characteristics of bright tobacco, not by adding an extrinsic flavorant per se, but by treating the tabacco in a novel manner.

It has been discovered, quite unexpectedly, that flue-cured bright tobacco treated by the method of this invention gains certain desirable burley-like flavor notes and effects in its flavor contribution to the smoke stream. The method involves the following steps:

(a) treating the tobacco with an excess of liquid ammonia at atmospheric pressure;

(b) separating the resulting liquid ammonia solution containing extracted tobacco components from the treated tobacco;

(c) concentrating this solution by evaporating substantially all the ammonia therefrom;

(d) dissolving the concentrate formed in step (c) in an appropriate solvent; and (e) applying the solution formed in step (d) to the treated tobacco of step (b).

These method steps may be repeated sequentially, if desired.

The present process may be employed to treat any tobacco material or non-tobacco substitute, but is presently most desirable with bright tobacco lamina having a moisture content of 4 to 22%. The lamina may also be in the form of cut filler.

Depending on the pressure employed, the temperature during the process may range from −80° C. to 50° C. At ambient atmospheric pressure, ammonia is a liquid (when maintained at −33.5° C.) and in this state is called cryogenic liquid ammonia. Preferably a temperature of between −33.5° C., the normal boiling point of ammonia at atmospheric pressure, and −60° C. is employed in the process of the present invention. The use of liquid ammonia at higher temperatures would require pressurized equipment to perform the process. Likewise, lower temperatures would require specialized cooling means which will avoid cooling below −77.7° C., the normal freezing point of ammonia. It is, therefore, preferable to utilize thermally insulated vessels in bringing about the contact of the bright tobacco with the cryogenic liquid ammonia.

Preferably the tobacco is immersed in the liquid ammonia. Alternatively, spray treatments may be utilized to the extent of saturating the tobacco with the liquid ammonia to the point of run-off.

The duration of contact is dependent upon the state of subdivision of the leaves, the amount of agitation applied during the contact period, the temperature of the ammonia and the pressure surrounding the tobacco material. The requisite duration of contact of the tobacco with the liquid ammonia has been found to be within the range of about one-half to five hours, regardless of the rate of removal of components from the tobacco. The amount of components removed from the tobacco by dissolution in the ammonia will range between about 5% and 40% of the initial weight of the tobacco.

The removed tobacco components are re-deposited upon the ammonia-treated tobacco by any of several methods, such as permitting evaporation of the solute-containing liquid ammonia in contact with the tobacco, spraying the solute-containing ammonia back onto the tobacco which provided said solute, or isolating the solute by evaporation of the ammonia, followed by dissolving the solute material in a new solvent such as water or alcohol to form a solution which is sprayed back onto the tobacco or onto a non-tobacco substrate.

The result of the aforesaid treatment is to produce a bright tobacco which, when blended, has smoking qualities in many ways quite similar to those of similar blends containing burley tobacco.

Other aspects and advantages of the present invention will be readily apparent upon consideration of the following detailed description of preferred embodiments thereof.

DETAILED DESCRIPTION OF THE INVENTION

The following examples are illustrative of presently preferred embodiments of the present invention. The process conditions and specific apparatus referred to herein are common in the art and various modifications can be derived in view of the foregoing disclosure within the scope of the invention.

The following examples illustrate the method of the present invention and subjective evaluation of the resulting tobacco products.

EXAMPLE 1

Approximately 65 g of bright tobacco in the form of cut filler at 11% OV were placed in a Soxhlet extraction apparatus fitted with a dry ice condenser and provided with a receiving flash. Gaseous ammonia was allowed to condense and percolate through the tobacco bed until the extract was nearly colorless. This was repeated 3 times to obtain material for subjective evaluation. The liquid ammonia was allowed to evaporate and the residue was dissolved in water.

The aqueous solution was sprayed onto the extracted filler at an equivalent weight rate. The filler was thereafter fabricated into cigarettes for subjective evaluation.

When compared to a similar cigarette consisting of untreated bright tobacco filler, the treated tobacco cigarettes were described as having more mouth impact, some burley flavor notes and more blended character.

EXAMPLE 2

Bright tobacco in lamina form was placed in a 5-liter reaction kettle fitted with a dry ice condenser. Gaseous ammonia was allowed to condense onto the tobacco bed until the tobacco was completely immersed. After standing for 2 hours, the ammonia was allowed to distill off the tobacco into a cold (−80° C.) receiver. The treated tobacco was allowed to air overnight and was removed from the flask. This process was repeated until a total of 15 lbs. of lamina had been treated. The combined portions of treated bright tobacco were manufactured into cigarettes for subjective evaluation.

Evaluation of these cigarettes clearly revealed a reduction in bright tobacco character and an increase in burley character. These cigarettes were generally judged to have blended tobacco flavor effects and were significantly preferred to cigarettes manufactured from the bright tobacco which had been impregnated with gaseous ammonia.

Numerous modifications and variations in the practice of the invention are expected to occur to those skilled in the art upon consideration of the foregoing descriptions of preferred embodiments thereof. Consequently, only such limitations as appear in the amended claims should be placed upon the scope of the invention.

What is claimed is:

1. A method for modifying the smoke flavor characteristics of bright tobacco comprising the steps of:

treating said tobacco with liquid ammonia at a temperature of between about −80° C. to about 50° C. in an amount sufficient to obtain a liquid extract comprising ammonia and extracted tobacco components; and applying said liquid extract to said treated tobacco.

2. The method according to claim 1, wherein said treating step has a duration of between about ½ to about 5 hours.

3. The method according to claim 1, wherein said temperature is within the range of −60° C. to −33.5° C.

4. The method according to claim 1, wherein said bright tobacco has a moisture content of between about 4 to about 22%.

5. The method according to claim 1, wherein said treating step employs atmospheric pressure.

6. The method according to claim 1, wherein said applying step comprises permitting the liquid ammonia in said extract to evaporate while said liquid extract is in contact with said tobacco.

7. The method according to claim 1, wherein said applying step comprises:

separating said liquid extract from the treated tobacco; and reapplying said liquid extract to said treated tobacco.

8. The method according to claim 1, wherein said applying step comprises the steps of:

(a) separating said liquid extract from said treated tobacco;

(b) evaporating all ammonia from said extract to provide a concentrate of said tobacco components;

(c) dissolving said concentrate in an appropriate solvent; and (d) applying the solution of step (c) to said treated tobacco.

9. The method according to claim 8, wherein said solvent of step (c) is selected from the group consisting of water and an alcohol.

* * * * *